US006105957A

United States Patent [19]

Miller et al.

[11] Patent Number: 6,105,957

[45] Date of Patent: Aug. 22, 2000

[54] BUCKLE ACCUMULATOR HAVING SELECTIVELY ACTIVATEABLE SHEET DEFLECTOR

[75] Inventors: John P. Miller, Shelton; Chiping Sye, Stamford, both of Conn.; William B. Riley, Alexandra, Va.

[73] Assignee: Pitney Bowes Inc., Stamford, Conn.

[21] Appl. No.: 09/163,685

[22] Filed: Sep. 30, 1998

[51] Int. Cl.[7] ..... B65H 31/00; B65H 29/70; B65H 9/04; B65H 31/30; B65G 57/00

[52] U.S. Cl. ..... 271/209; 271/188; 271/245; 414/789.9; 414/790.2; 414/794.8

[58] Field of Search ..... 271/188, 207, 271/209, 220, 241, 242, 245, 246, 266; 414/789.9, 794.4, 790.2, 790.7, 794.8

[56] References Cited

U.S. PATENT DOCUMENTS

| | | | |
|---|---|---|---|
| 4,575,069 | 3/1986 | Burkhart | 271/186 |
| 5,356,263 | 10/1994 | Miller | 414/790.7 |
| 5,543,909 | 8/1996 | Quesnel | 399/394 |
| 5,596,399 | 1/1997 | Dempsey et al. | 399/45 |

*Primary Examiner*—Donald P. Walsh
*Assistant Examiner*—Brett C. Martin
*Attorney, Agent, or Firm*—Angelo N. Chaclas; Michael E. Melton

[57] ABSTRACT

A buckle accumulator including an input feed system, an output feed system located downstream in a path of travel from the input feed system, a receiving space located adjacent the path of travel between the input feed system and the output feed system, and a deflector. The input feed system feeds a plurality of sheets one at a time in a path of travel into the buckle accumulator. Each of the plurality of sheets has a leading edge and a trailing edge. The output feed system feeds a stack of sheets out of the buckle accumulator. Generally, the lead edge for each of the plurality of sheets is substantially unrestrained between the input feed system and the output feed system. The receiving space accepts the plurality of sheets one at a time to create the stack. The deflector is mounted in proximity to the receiving space for selectively actuating between a first position out of contact with a first sheet previously accumulated in the receiving space and a second position in contact with the first sheet. The first sheet having a first configuration when the deflector is in the first position and a second configuration when the deflector is in the second position. The deflector is in the second position when the lead edge of a second sheet is between the input feed system and the output feed system so that a portion of the first sheet in the second configuration forms a guide to assist the lead edge of the second sheet in following the path of travel and entering the output feed system.

17 Claims, 13 Drawing Sheets

BUCKLE ACCUMULATOR HAVING SELECTIVELY ACTIVATEABLE SHEET DEFLECTOR

CROSS REFERENCE TO RELATED APPLICATIONS

This patent application is related to concurrently filed U.S. patent application Code/Ser. No. 09/163,650 entitled CORRUGATED INPUT FEED FOR A BUCKLE ACCUMULATOR, the disclosure of which is specifically incorporated herein by reference.

FIELD OF THE INVENTION

This invention relates to sheet accumulators that collect a plurality of sheets to form a stack of sheets. More particularly, this invention is directed to an accumulator including an input set of rollers forming a first nip and an output set of rollers forming a second nip where the sheets are accumulated into a receiving space and a selectively activateable deflector reshapes a portion of a first sheet to act as a guide for assisting the lead edge of a subsequent sheet in reaching the second nip.

BACKGROUND OF THE INVENTION

It is known to be desirable in the paper handling art to provide paper handling apparatus, such as: copiers, inserters, and the like, with mechanisms, known as accumulators, which accumulate a sequence of sheets being processed by the apparatus to form a stack, or accumulation, for further processing. For example, a sequence of sheets might be fed to a printer for printing of predetermined information, and the output of the printer fed to an accumulator where a predetermined number of sheets in the sequence would be accumulated, and the resulting accumulation passed on for further processing, such as folding and insertion into an envelope.

Referring to FIG. 1, an example of a buckle type prior art accumulator 10 as substantially taught by U.S. Pat. No. 5,356,263 is shown. The accumulator 10 includes a feed mechanism 20 including a pair of input rollers 22 and a pair of output rollers 24 for feeding a sheet S1 along a first path until the sheet is deflected onto a second path. The feed mechanism 20 continues to drive the sheet S1 along the second path until the leading edge LE reaches a selectively activateable accumulating stop 12 which halts the leading edge LE of the sheet S1. The input rollers 22 continue to drive the sheet S1 so that the sheet S1 buckles away from the first path in a direction defined by the deflection of the sheet S1. As the input rollers 22 continue to feed the sheet S1 a loop forms B1 and the sheet S1 unrolls into a receiving space 30, which may be no more than an open area provided in the accumulator, so that as the trailing edge TE of the sheet S1 clears the feeder mechanism 20, the trailing edge TE and a substantial portion of the sheet S1 are displaced into the receiving space 30 and away from the first path as defined by the nip of the input rollers 22. Thus, the sheet S1 may be followed by a next sheet S2 which similarly reaches the stop 12 causing a respective loop B2 to form resulting in the accumulation of the next sheet S2 with the first sheet S1.

Although such accumulators generally work well, some difficulties have been experienced. Generally, the need for a receiving space 30 so as to allow the buckle or loop to form does not lend itself to the placement of a guide in an area 50 of the receiving space 30 adjacent to the feed path located between the input rollers 22 and the output rollers 24. As a result, the lead edge LE of the sheet S1 is not controlled on both sides of the sheet S1 meaning that the sheet S1 must bridge the gap between the nip of the input rollers 22 and the nip of the output rollers 24. Therefore, the lead edge LE is susceptible to wandering off the feed path due to a variety of reasons, such as: paper curl, vibration, air turbulence, and the like. Thus, the likelihood of paper jams is increased because the lead edge LE of the sheet S1 may stall in the area 50 of the receiving space 30 and not properly reach the nip of the output rollers 24 resulting in reduced reliability of the accumulator. This is due to the fact that a portion of the sheet S1 extending out from the nip of the input rollers 22 is cantilevered (supported at only one end) until it reaches the nip of the output rollers 22. Contributing to this problem is a practical requirement that the nip of the input rollers 22 cannot be located too close to the nip of the output rollers 24 because adequate leeway must be provided to allow the loop B1 to form. As a result, the gap between the nip of the input rollers 22 and the nip of the output rollers 24 is greater than what one skilled in the art will normally employ in view of the fact that a guide cannot be placed in area 50.

Thus, there is a need for an improved buckle accumulator that reduces the likelihood of jams and increases overall reliability of the accumulator. More particularly, there is a need for a buckle accumulator that provides increased control of the lead edge of a sheet as it is fed from the input rollers to the output rollers.

SUMMARY OF THE INVENTION

The present invention provides a cost effective means for substantially addressing those problems identified in the prior art and improving the reliability of the buckle accumulator. In conventional fashion, this invention may be incorporated into a variety of sheet handling systems, such as: copiers, inserters and the like.

In accordance with the present invention, there is provided a buckle accumulator including an input feed system, an output feed system located downstream in a path of travel from the input feed system, a receiving space located adjacent the path of travel between the input feed system and the output feed system, and a deflector. The input feed system feeds a plurality of sheets one at a time in a path of travel into the buckle accumulator. Each of the plurality of sheets has a leading edge and a trailing edge. The output feed system feeds a stack of sheets out of the buckle accumulator. Generally, the lead edge for each of the plurality of sheets is substantially unrestrained between the input feed system and the output feed system. The receiving space accepts the plurality of sheets one at a time to create the stack. The deflector is mounted in proximity to the receiving space for selectively actuating between a first position out of contact with a first sheet previously accumulated in the receiving space and a second position in contact with the first sheet. The first sheet having a first configuration when the deflector is in the first position and a second configuration when the deflector is in the second position. The deflector is in the second position when the lead edge of a second sheet is between the input feed system and the output feed system so that a portion of the first sheet in the second configuration forms a guide to assist the lead edge of the second sheet in following the path of travel and entering the output feed system.

In accordance with the present invention, there is also provided a method of accumulating sheets and a method of manufacturing a buckle accumulator.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DESCRIPTION OF THE PREFERRED EMBODIMENTS

Figure 1:
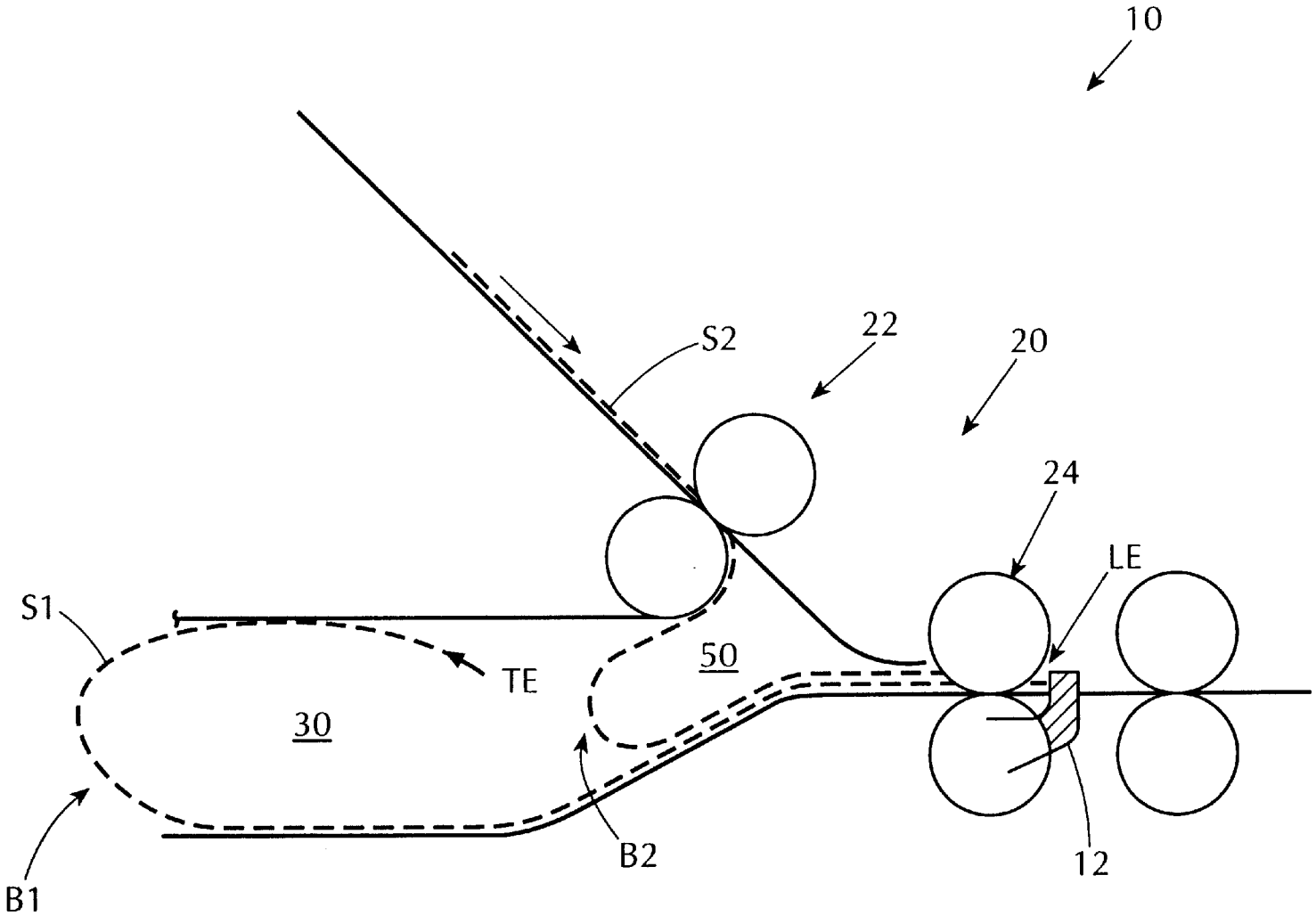
FIG. 1 PRIOR ART
FIG. 1 is a schematic representation of an elevational view of a prior art buckle accumulator.
Figure 2:
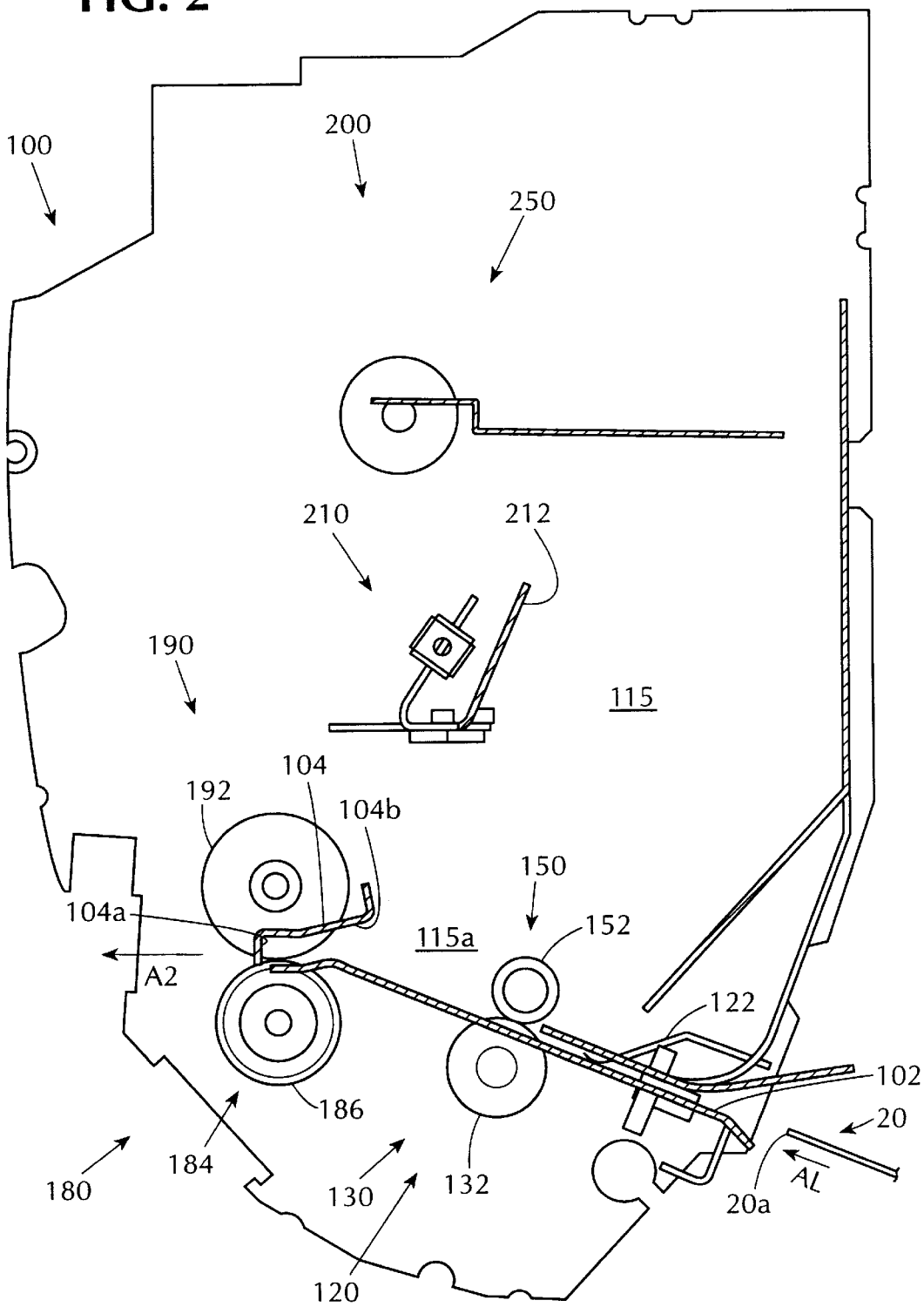
FIG. 2 is a schematic representation of an elevational view of a buckle accumulator showing a sheet being fed into the buckle accumulator in accordance with the present invention.

Referring to FIG. 2, an example of a buckle accumulator 100 in which the present invention may be employed is shown. The buckle accumulator 100 includes an input feed system 120 and an output feed system 180 for feeding a sheet along a deck 102. Generally, the input feed system 120 and the output feed system 180 cooperate along with a selectively actuated stop 104 to accumulate a sheet 20 in a receiving space 115 of the buckle accumulator 100. After a predetermined number of sheets 20 have been accumulated into a stack (not shown), the stack is feed out of the accumulator 100 by the output feed system 180. For the sake of clarity, the nip of the input feed system 120 has been offset from the deck 102 in the elevational views. The buckle accumulator 100 further includes a deflector system 200. The deflector system 200 includes a fixed support assembly 210 and a selectively actuated deflector assembly 250.

The sheet 20 enters the buckle accumulator 100 from an upstream module (not shown), such as a printer, burster, or the like, and is feed in a first path of travel as indicated by the arrow Al. The input feed system 120 receives the sheet 20 from the upstream module and continues to feed the sheet 20 in the path of travel until a lead edge 20*a* of the sheet 20 encounters the stop 104. In an accumulate position, the stop 104 provides an obstructing surface 104*a* disposed within the first feed path that prevents the sheet 20 from continuing downstream. In an output position (not shown), the obstructing surface 104*a* is removed from the first feed path allowing the sheet 20 or a stack thereof to be fed out of the accumulator 100 by the output feed system 180 in a second feed path as indicated by arrow A2. Together, the first feed path and the second feed path are sometimes commonly referred to as a path of travel.

Preferably, the output feed system 180 is designed to have some degree of slippage with the sheet 20 once the lead edge 20*a* reaches the obstructing surface 104*a*. In this manner, the output feed system 180 may continue to operate with the stop 104 in the accumulate position without further advancing the sheet 20. Alternatively, the output feed system 180 may be provided with a more positive nip and can be selectively operated to feed the sheet 20: (i) until the lead edge 20*a* of each sheet reaches the obstructing surface 104*a;* and (ii) when feeding the stack (not shown) out of the accumulator 100.

To assist the lead edge 20*a* in reaching the output feed system 180, the stop 104 includes a guide portion 104*b* that is angled back toward the receiving space 115. Thus, as the input feed system 120 feeds the sheet 20, the guide portion 104*b* directs the lead edge 20*a* to the output feed system 180. After the lead edge 20*a* reaches the obstructing surface 104*a,* the input feed system 120 continues to feed the sheet 20 causing the sheet 20 to buckle toward the receiving space 115. Still further feeding by the input feed system 120 causes the buckling portion of the sheet 20 to unroll into the receiving space 115 as will be shown further in subsequent Figures. However, as described above, to allow the buckle to form and enter the receiving space 115, the guide portion 104b is preferably not too close to the input feed system 120 so that a portion 115*a* of the receiving space 115 located between the input feed system 120 and the output feed system 180 and adjacent the first feed path is substantially unobstructed.

The input feed system 120 includes a drive system 130, an idler system 150 and a leaf spring 122. The drive system 130 includes a drive roller 132 that is operatively coupled by any conventional means to a motor (not shown) for causing the drive roller 132 to rotate. The idler system 150 includes an idler roller 152 mounted in opposed relationship to the drive roller 132 to form a nip therebetween. Preferably, the idler roller 152 is spring biased by any conventional means (not shown) toward the driven roller 132 so that the sheet 20 remains in intimate contact with the drive roller 132. The leaf spring 122 is biased toward the deck 102 to assist in keeping the sheet 20 flat against the deck 102 and reduces paper flutter between the drive rollers 132. Generally, the input feed system 120 feeds the sheet 20 along the deck 102 in the first feed path until the lead edge 20 reaches the stop 104.

Similar to the input feed system 120, the output feed system 180 includes a drive system 184 and an idler system 190. The drive system 184 includes a drive roller 186 that is operatively coupled by any conventional means to a motor (not shown) for causing the drive roller 186 to rotate. The idler system 190 includes an idler roller 192 mounted in opposed relationship to the drive roller 186 to form a nip therebetween.

Figure 3:
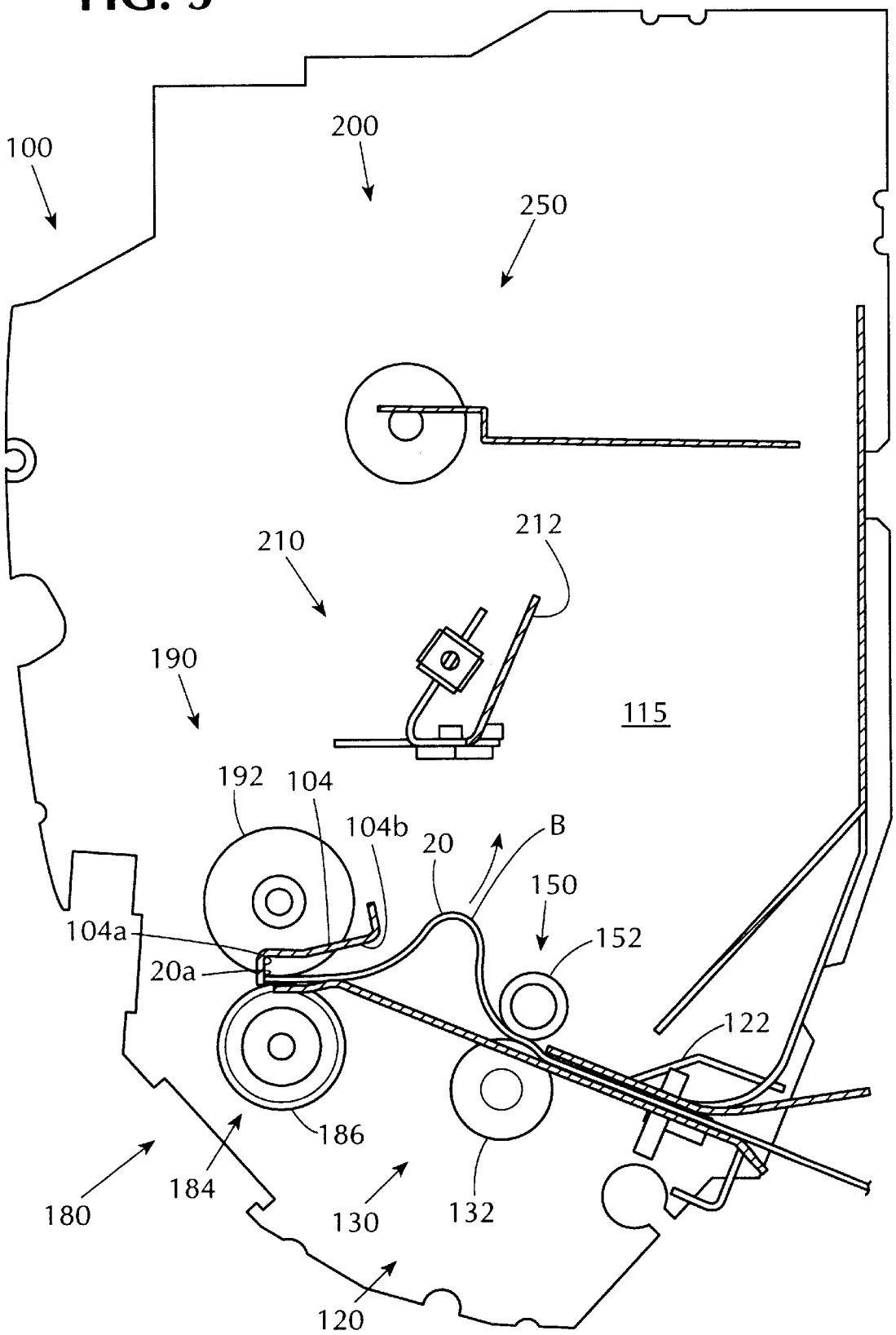
FIG. 3 is a schematic representation of an elevational view of the buckle accumulator showing the sheet being buckled and entering a receiving space of the buckle accumulator in accordance with the present invention.

Referring to FIG. 3, a schematic representation of an elevational view of the buckle accumulator 100 where the sheet 20 is being buckled and is entering the receiving space 115 of the buckle accumulator 100 is shown. At this point in time, the lead edge 20*a* of the sheet 20 has reached the stop 104 and a buckle B is beginning to form expanding into the receiving space 115.

Figure 4:
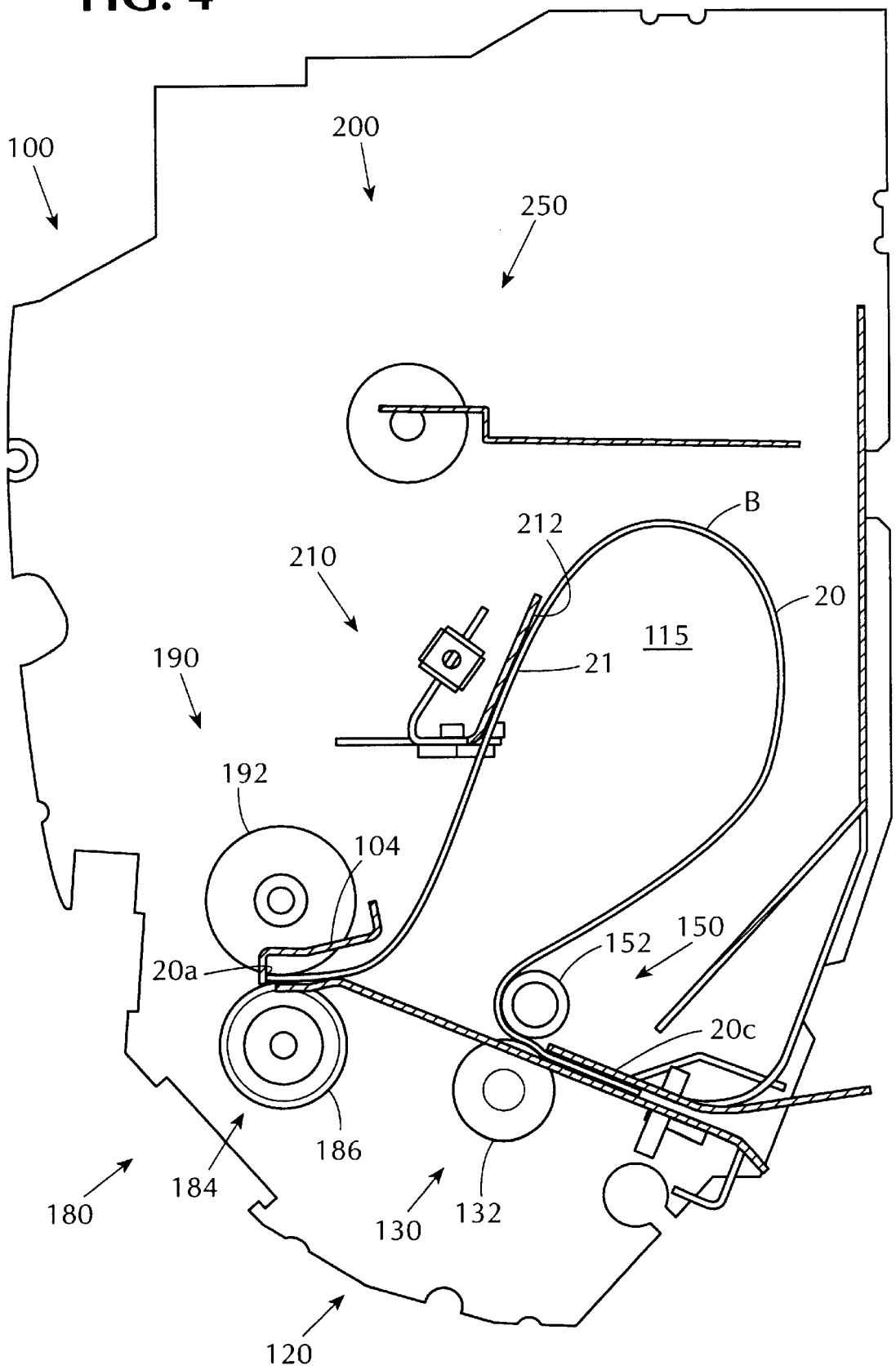
FIG. 4 is a schematic representation of an elevational view of the buckle accumulator showing the sheet being buckled and a trail edge of the sheet exiting an input feed system in accordance with the present invention.

Referring to FIG. 4, which is at a later point in time than FIG. 3, a schematic representation of an elevational view of the buckle accumulator 100 where the buckle B continues to enlarge and a trail edge 20*c* of the sheet 20 has almost exited the input feed system 120 is shown. The fixed support assembly 210 includes a first support surface 212 mounted by any conventional means around the periphery of the receiving space 115. A first portion 21 of the sheet 20 proximate to the lead edge 20*a* of the sheet 20 abuts the first support surface 212. Thus, the first portion 21 of the sheet 20 is in bearing contact with the first support surface 212.

Figure 5:
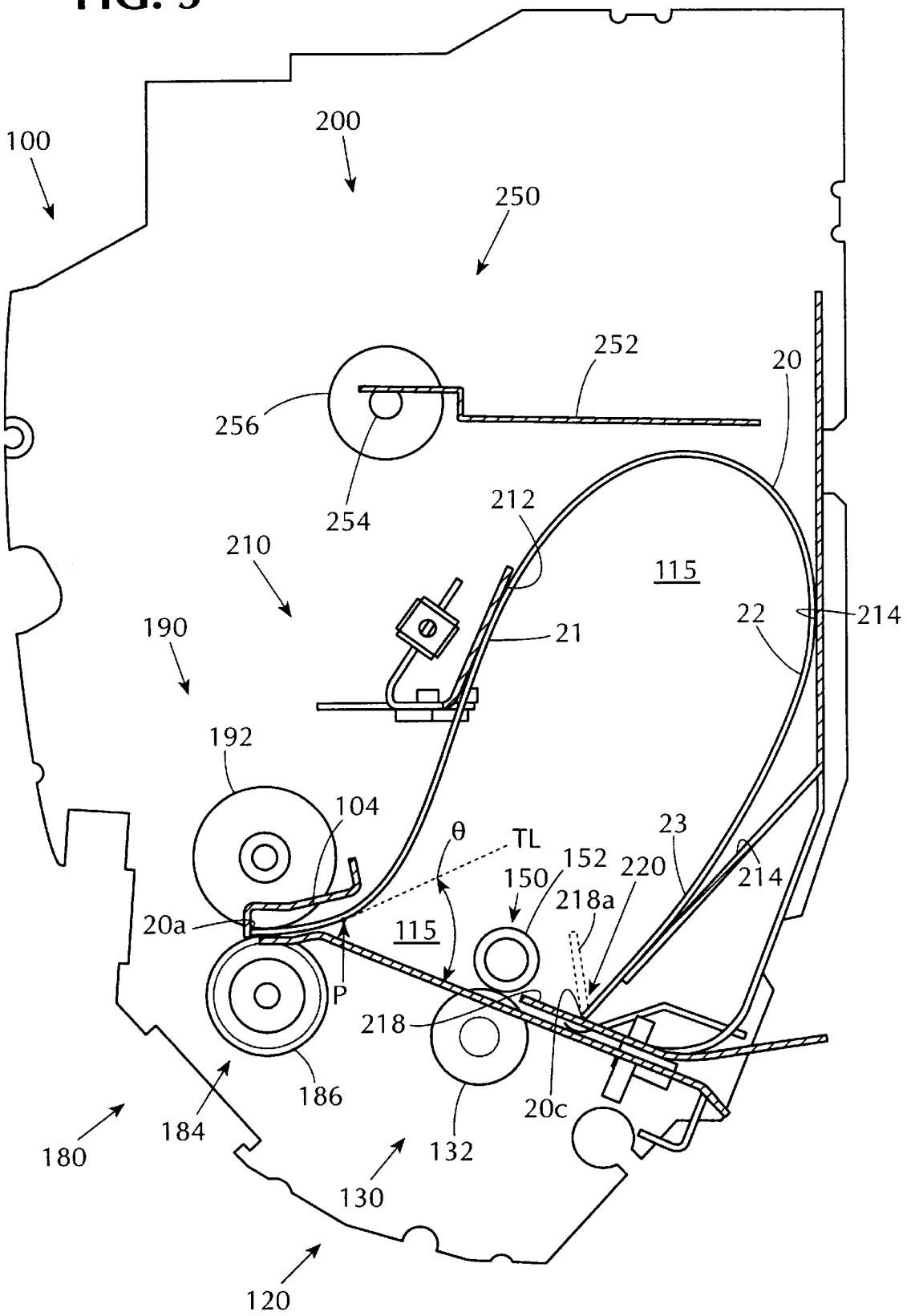
FIG. 5 is a schematic representation of an elevational view of the buckle accumulator showing a first sheet fully accumulated in the receiving space in accordance with the present invention.
Figure 10:
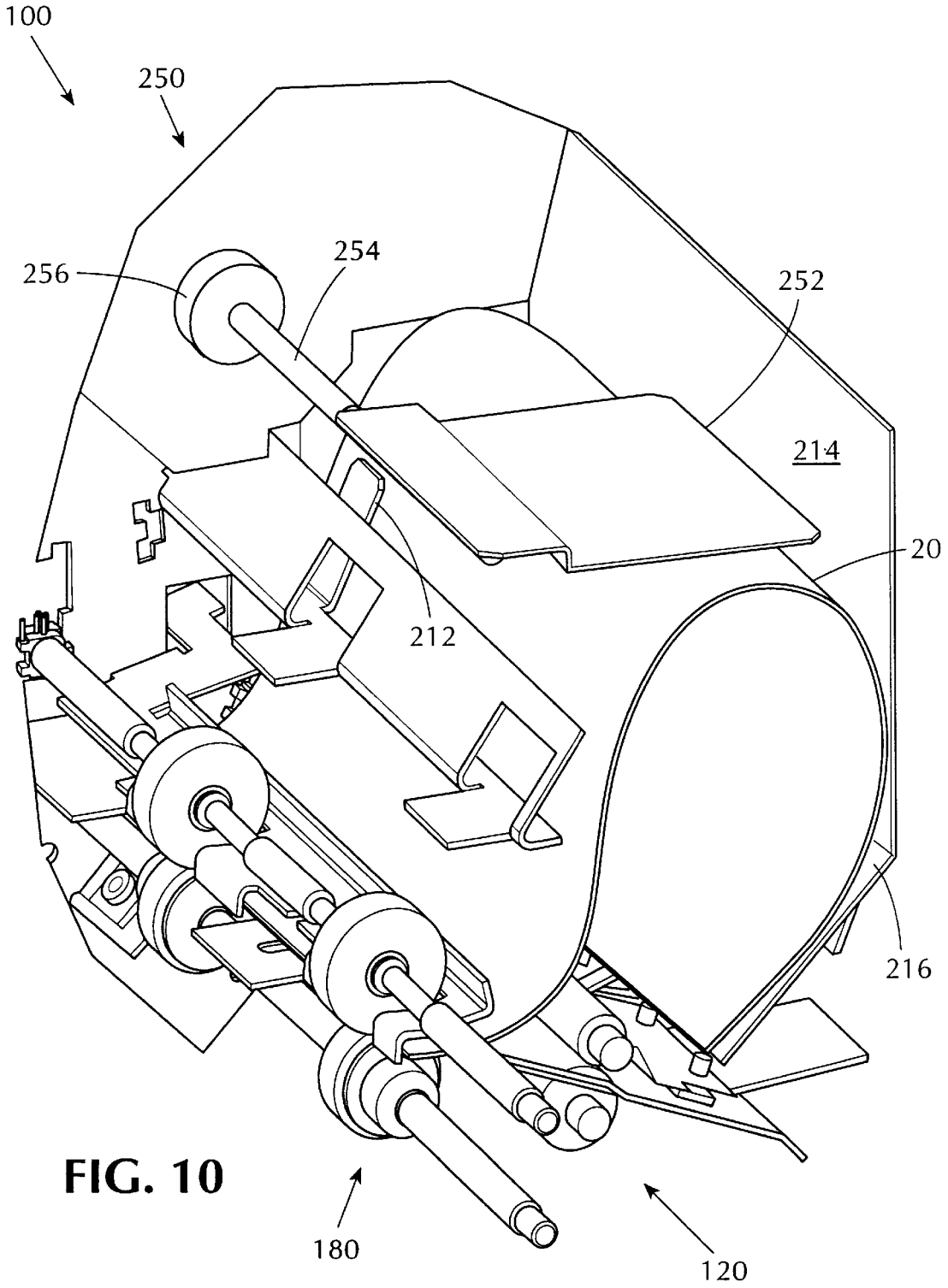
FIG. 10 is a simplified perspective view of the buckle accumulator showing the first sheet fully accumulated in the receiving space in accordance with the present invention.

Referring to FIGS. 5 and 10, which is at a later point in time than FIG. 4, a schematic representation of an elevational view of the buckle accumulator 100 where a first sheet 20 is fully accumulated in the receiving space 115 is shown. The fixed support assembly 210 further includes a second support surface 214, a third support surface 216 and a fourth support surface 218, each mounted by any conventional means around the periphery of the receiving space 115. A second portion 22 of the sheet 20 adjacent to and downstream in the path of travel from the first portion 21 abuts the second support surface 214. Thus, the second portion 22 of the sheet 20 is in bearing contact with the second support surface 214. Similarly, a third portion 23 of the sheet 20 adjacent to and downstream in the path of travel from the second portion 22 abuts the third support surface 216. Thus, the third portion 23 of the sheet 20 is in bearing contact with the third support surface 216. The trailing edge 20*c* of the sheet 20 abuts the fourth support surface 218. Thus, the trailing edge 20*c* is restrained.

Those skilled in the art will recognize that the various support surfaces 212, 214, 216 and 218 that make up the fixed support assembly 210 could all be combined into a single contiguous guide (not shown) with suitable openings for the deflector 250. Alternatively, the various support surfaces 212, 214, 216 and 218 may be partitioned into any desired combination of contiguous surfaces.

Alternatively, the trailing edge 20*c* may be restrained by a notch 220 formed from the third support surface 216 and by repositioning the fourth support surface 218 as shown in dotted lines 218*a*. In this manner, the angle formed between the third support surface 216 and the dotted lines 218*a* is more acute and may provide additional lateral stability, if needed, to the trailing edge 20*c*.

Figure 6:
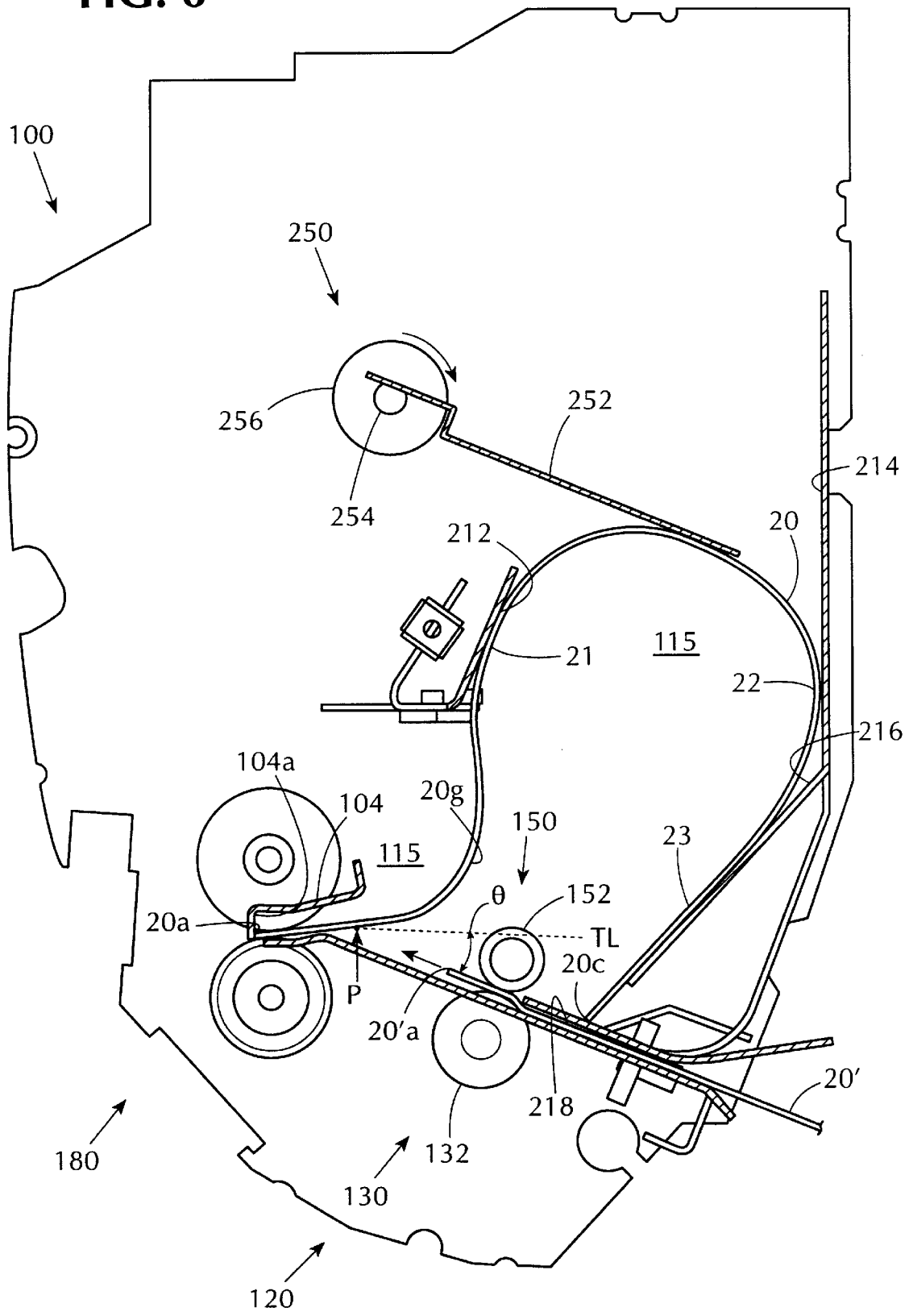
FIG. 6 is a schematic representation of an elevational view of the buckle accumulator showing a subsequent sheet being fed into the buckle accumulator and a deflector reshaping the first sheet in accordance with the present invention.

Referring to FIG. 6, which is at a later point in time than FIG. 5, a schematic representation of an elevational view of the buckle accumulator 100 where a subsequent sheet 20' is being fed into the buckle accumulator 100 while the deflector assembly 250 is reshaping the first sheet 20 is shown. Although, the subsequent sheet 20' is in the nip of the input feed system 120, the lead edge 20'*a* has not reached the obstructing surface 104*a* of the stop 104. The deflector assembly 250 includes a deflector 252 mounted to an output shaft 254 of a rotary solenoid 256.

When energized, the rotary solenoid 256 rotates the deflector 252 between a first position, as shown in FIGS. 2–5 and 7–9, and a second position as shown in FIG. 6. In the second position, the deflector 252 contacts the sheet 20 between the first portion 21 and the second portion 22 reshaping the sheet 20 from its original configuration into a deformed configuration. Since the sheet 20 is restrained by the obstructing surface 104*a,* the first support surface 212, the second support surface 214, the third support surface 216 and the fourth support surface 218, the reconfiguration of the shape of the sheet 20 is controlled. The result is that a portion 20*g* of the sheet 20 between the lead edge 20*a* and the first portion 21 protrudes further into the portion 115*a* of the receiving space 115 located between the input feed system 120 and the output feed system 180 and adjacent to the first feed path. The portion 20*g* of the sheet 20 behaves as a guide to assist the lead edge 20'*a* of the subsequent sheet 20' in reaching the nip of the output feed system 180. Further details of the deflector assembly 250 will be described below.

Figure 7:
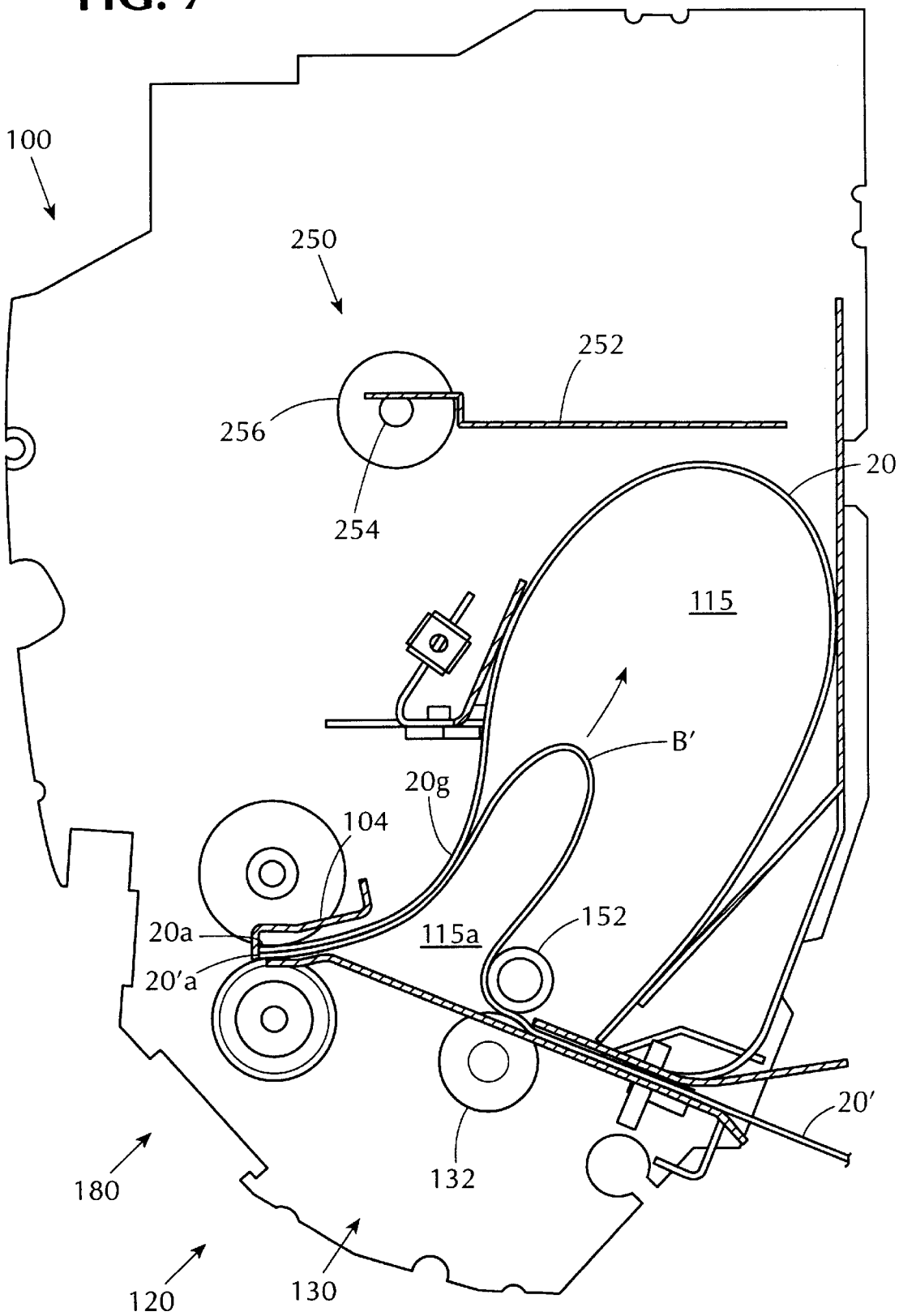
FIG. 7 is a schematic representation of an elevational view of the buckle accumulator showing the subsequent sheet being buckled and the deflector releasing from contact with the first sheet in accordance with the present invention.

Referring to FIG. 7, which is at a later point in time than FIG. 6, a schematic representation of an elevational view of the buckle accumulator 100 where the subsequent sheet 20' is being buckled is shown. The lead edge 20'*a* of the subsequent sheet 20' has reached the stop 104 and the buckle B' is beginning to form expanding into the receiving space 115. Since the lead edge 20'*a* is secured in the nip of the output feed system 180, the guide portion 20*g* of the sheet 20 is no longer needed. Thus, the deflector 250 may be returned to the first position releasing from contact with the sheet 20 so that the sheet 20 returns to its original configuration and does not impede the formation and expansion of the buckle B'.

Figure 8:
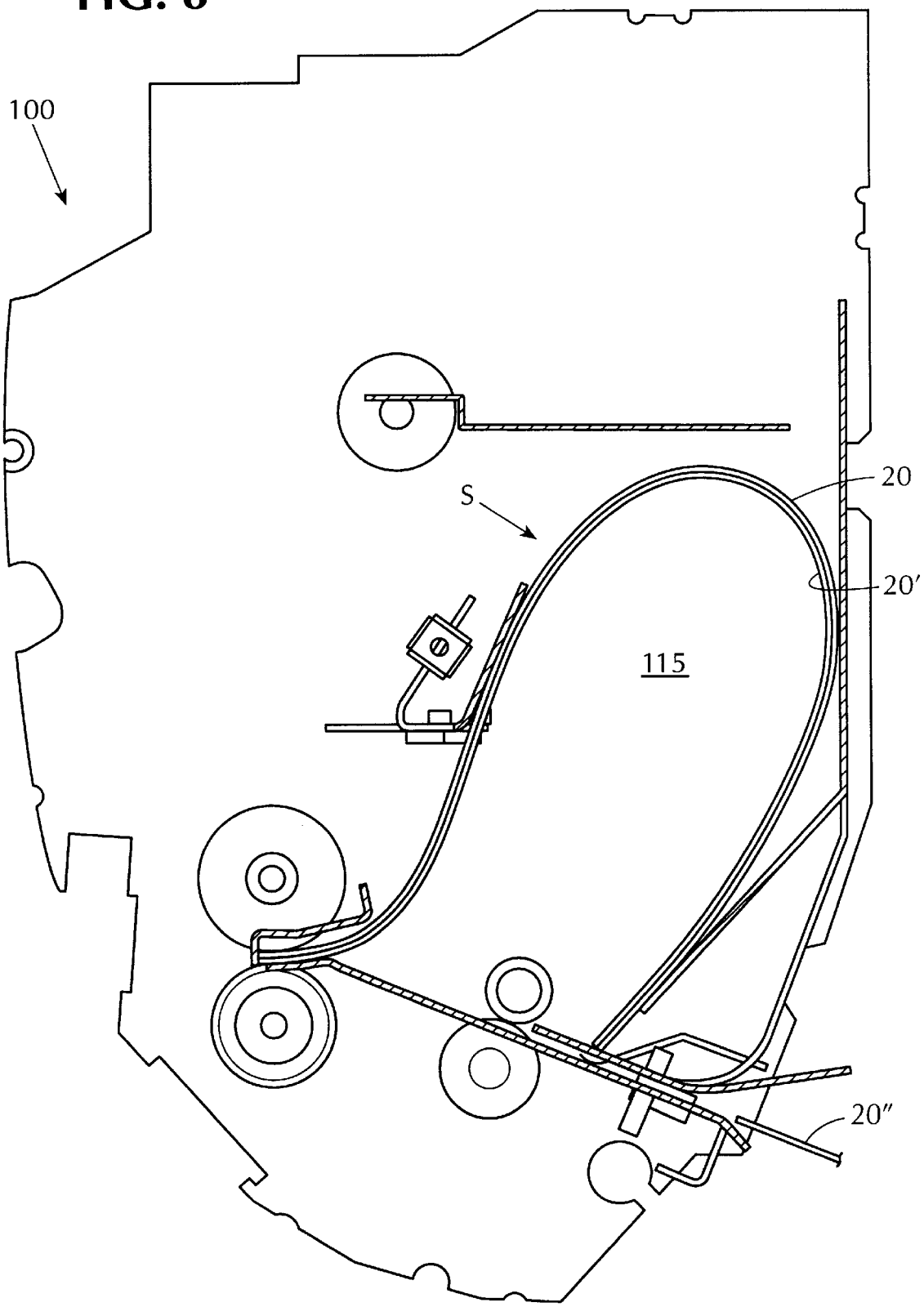
FIG. 8 is a schematic representation of an elevational view of the buckle accumulator showing the subsequent sheet fully accumulated with the first sheet in the receiving space to for a stack in accordance with the present invention.

Referring to FIG. 8, which is at a later point in time than FIG. 7, a schematic representation of an elevational view of the buckle accumulator 100 where the subsequent sheet 20' is fully accumulated along with the first sheet 20 in the receiving space 115 to form a stack S of sheets 20 is shown. Further sheets 20 may be accumulated into the stack S in the manner described above.

Figure 9:
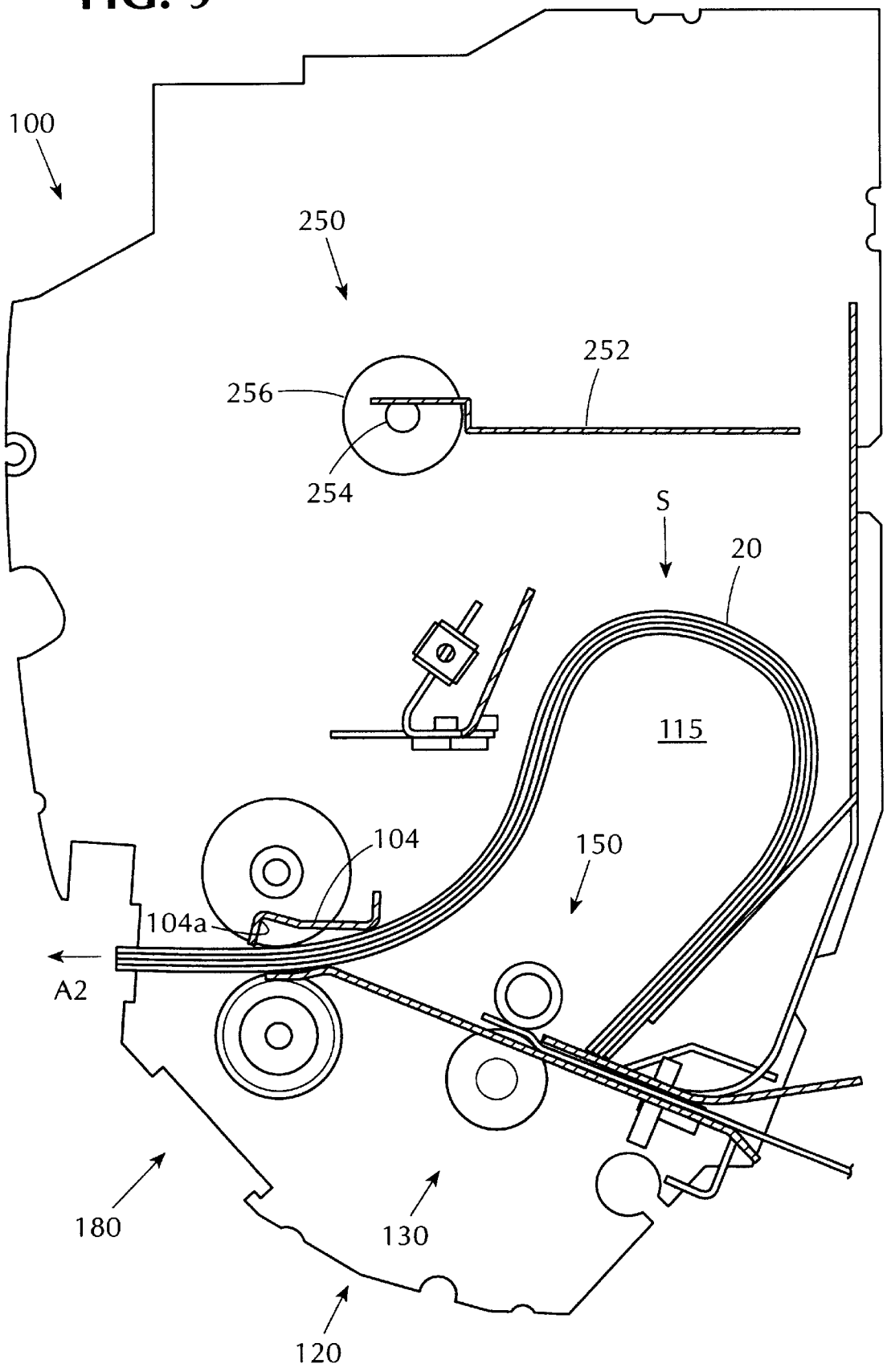
FIG. 9 is a schematic representation of an elevational view of the buckle accumulator showing a stack of sheets being fed from the buckle accumulator in accordance with the present invention.

Referring to FIG. 9, an elevational view of the buckle accumulator 100 showing the stack S of sheets 20 being fed out of the buckle accumulator 100 in the direction indicated by the arrow A2 is shown. At this point in time, the obstructing surface 104*a* of the stop 104 has been rotated out of the feed path. As an option (not shown), the deflector 252 may be rotated to the second position in cooperation with the removal of the obstructing surface 104*a* so that the stack S is maintained securely in the nip of the output feed system 180 and output of the stack S is facilitated.

Figure 11:
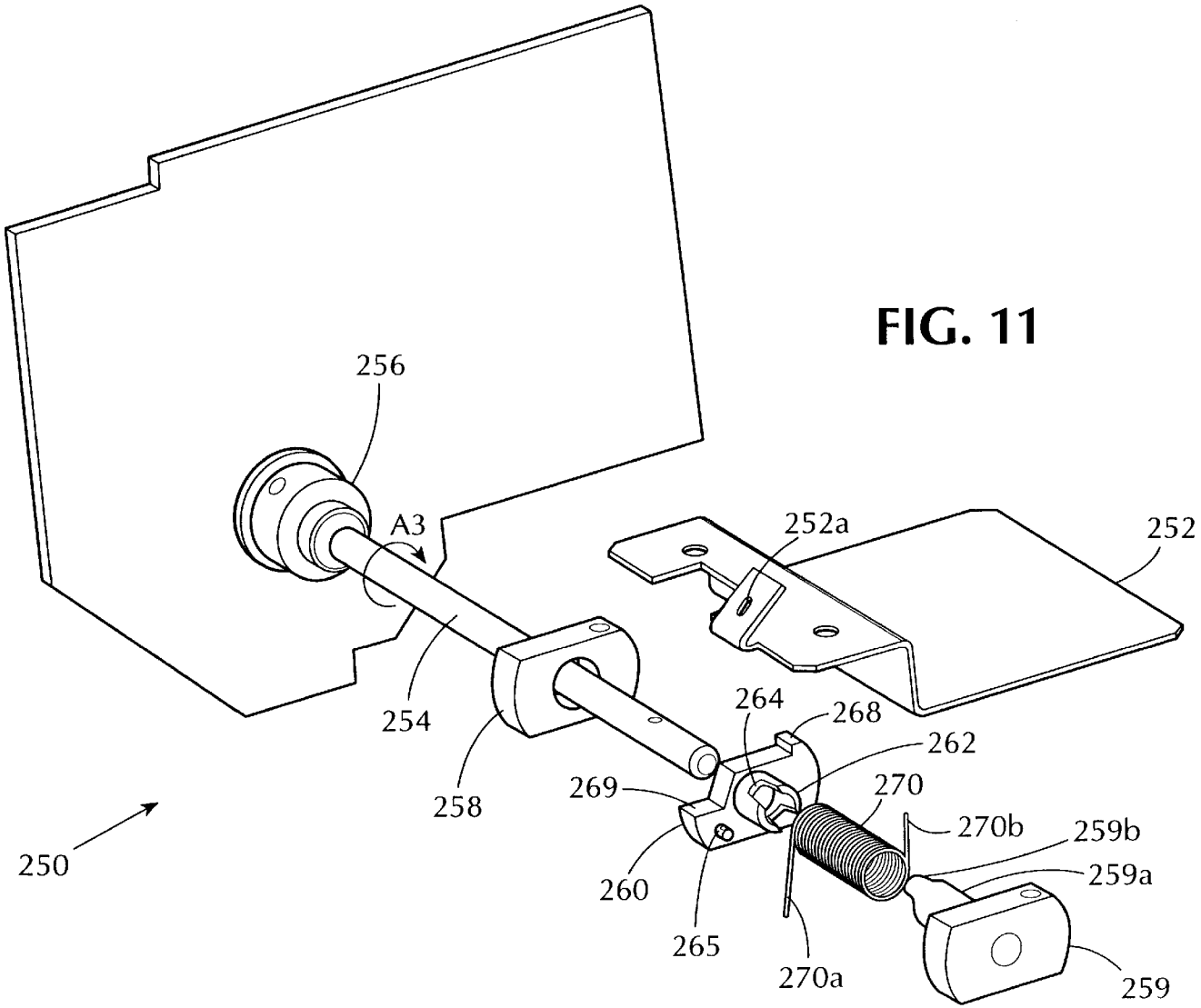
FIG. 11 is a simplified exploded perspective view of a deflector assembly in accordance with the present invention.
Figure 12:
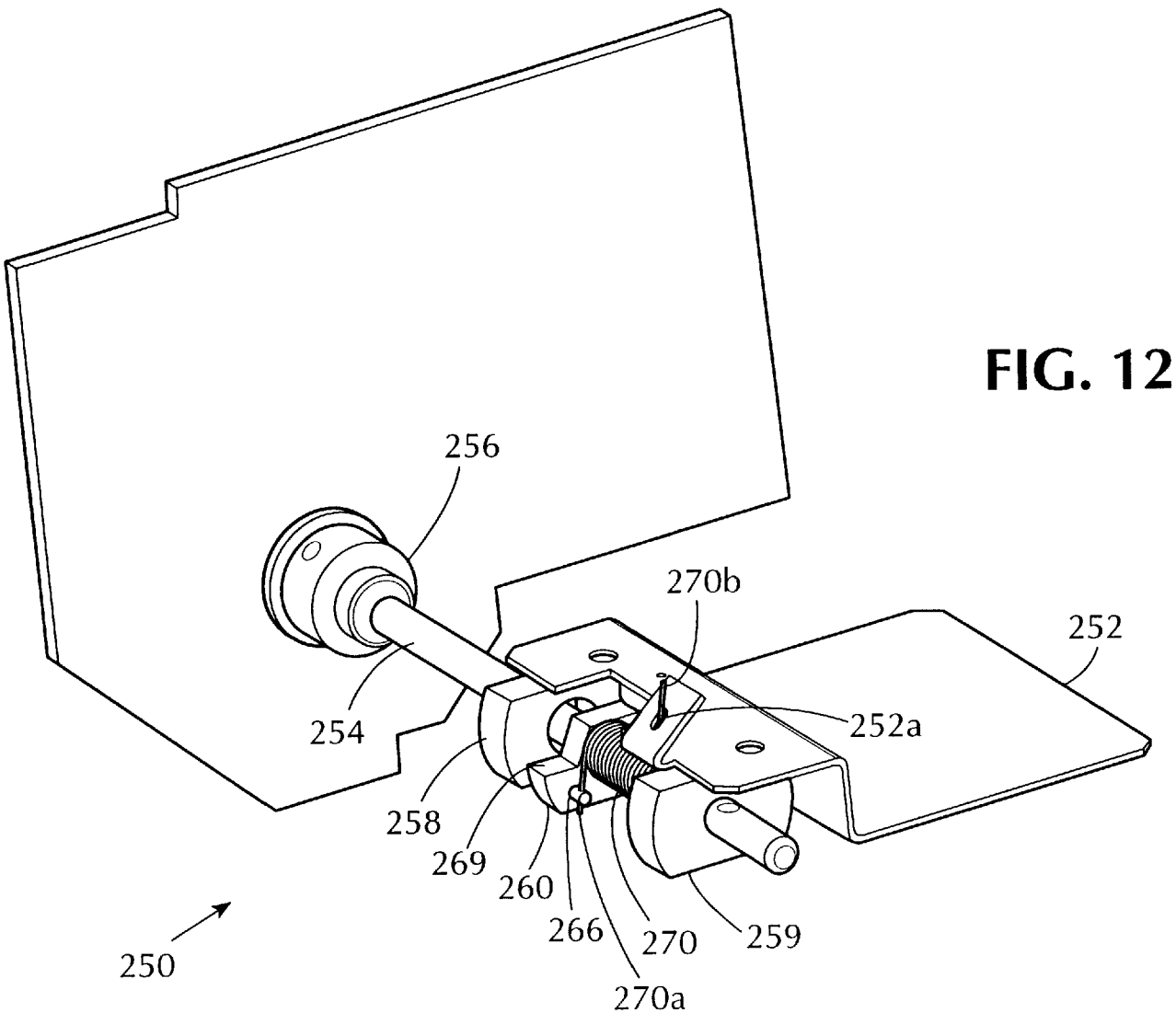
FIG. 12 is a simplified assembled perspective view of the deflector assembly in accordance with the present invention.

In view of the overall description of the buckle accumulator 100 provided above, the details of the deflector assembly 250 will now be described. Referring to FIGS. 11 and 12, a simplified exploded perspective view of a portion of the deflector assembly 250 in the first position and a simplified assembled perspective view of the deflector assembly 250 in the first position are shown, respectively. The deflector assembly 250 further includes a set of hubs 258, 259 and 260 and a spring 270. The deflector 252 is fixably mounted in any conventional manner to a pair of mounting hubs 258 and 259 which are in turn mounted to the output shaft 254. The mounting hubs 258 and 259 are free to slide along and rotate about the output shaft 254. The mounting hub 259 includes a cylindrical boss 259*a* in axial alignment with the output shaft 254. The boss 259*a* includes a v-shaped extension 259*b*. A locking hub 260 includes a cylindrical boss 262 in axial alignment with the output shaft 254 and is fixably mounted in any conventional manner to the output shaft 254. The boss 262 includes a notch 264. The locking hub 260 serves to position the deflector 252 along the output shaft 254 as will be described in more detail below.

The spring 270 is assembled axially over the bosses 259*a* and 262 and is captured between the locking hub 260 and the mounting hub 259. The spring 270 includes a first end 270*a* captured by a pin 266 extending from the locking hub 260 and a second end 270*b* extending through a hole 252*a* in the deflector 252. It should be appreciated that any conventional means of fastening the first end 270*a* of the spring 270 to the locking hub 260 will suffice. The spring 270 is assembled with a first pre-load such that the deflector 252 is biased in a clockwise direction around the output shaft 254 as indicated by the arrow A3. In normal operation, the deflector 252 is held in an operative position with respect to the output shaft 254 by the locking hub 260 and the spring 270. The spring 270 is assembled with a second pre-load such that the deflector 252 is biased axially along the output shaft 254 toward the solenoid 256. In this manner, the v-shaped extension 259*b* of the boss 259*a* on the mounting hub 259 is seated within the notch 264 of the boss 262 on the locking hub 260 so that the mounting hub 259 and the locking hub 260 are "keyed" together. Thus, in normal operation, as the output shaft 254 rotates, the locking hub 260 rotates causing the deflector 252 to rotate in kind between the first and second positions as described above.

Those skilled in the art will recognize that the mounting hubs 258 and 259 may be a single piece, since one the deflector 252 is mounted, the hubs 258 and 259 remain in a fixed relationship. Alternatively, the mounting hubs 258 and 259 may be incorporated directly into the deflector 252.

Figure 13:
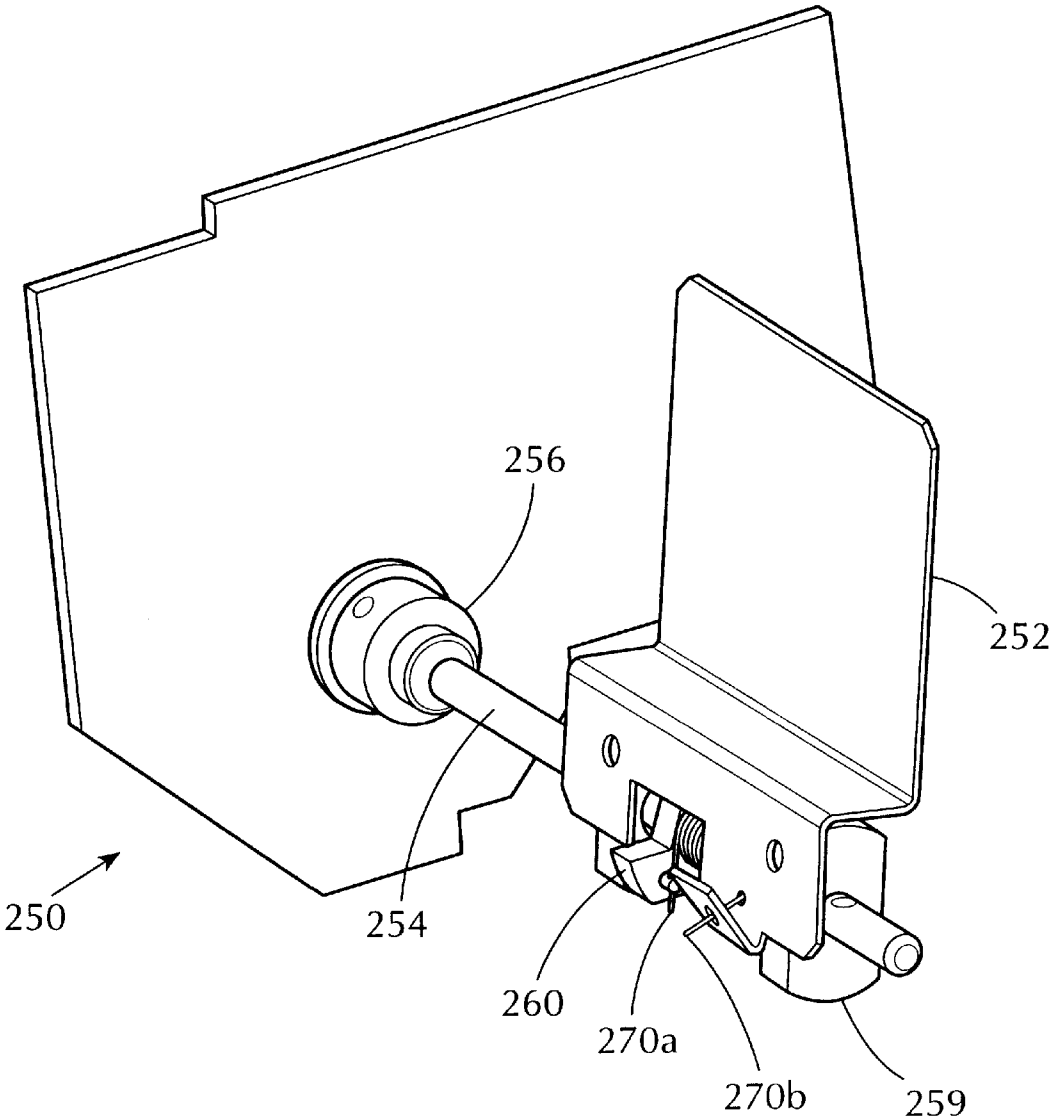
FIG. 13 is a simplified assembled perspective view of the deflector assembly in a jam access position in accordance with the present invention.

Referring to FIG. 13, the deflector 252 is shown in a jam access position. Referring to FIGS. 2 and 11–13, there may be occasions when an operator needs access to the receiving space 115 to clear a jam or perform other maintenance tasks. Thus, the deflector assembly 250 is provided with jam access capability to facilitate operator entry into the receiving space 115. To gain access to the receiving space 115, the operator first pulls the deflector 252 axially along the shaft 254 in a direction away from the solenoid 256. This has the effect of unseating the v-shaped extension 259*b* of the boss 259*a* on the mounting hub 259 from the notch 264 of the boss 262 on the locking hub 260 so that the mounting hub 259 and the locking hub 260 are no longer "keyed" together. Next, the operator is free to rotate the deflector 252 about the shaft 254 in a counter-clockwise direction. A stop 268 located on the locking hub 260 prevents the operator from rotating the deflector 252 in the clockwise direction once the mounting hub 259 and the locking hub 260 are separated. The operator may continue to rotate the deflector 252 until the deflector encounters a stop 269 located on the locking hub 260 opposite to the stop 268. From this position, the spring 270 is both extended and rotated, thus the spring 270 serves to return the v-shaped extension 259*b* to the seated position once the operator releases the deflector 252. Thus, the risk of the operator leaving the deflector 252 in the jam access position is eliminated.

Referring to FIGS. 5 and 6, those skilled in the art will recognize a further advantage of the present invention. When the deflector 250 is in the first position out of contact with the sheet 20, the sheet 20 is in its original configuration as described above. In the original configuration, the sheet 20 forms a steep contact angle θ with the path of travel. The contact angle θ defined by a line TL drawn tangent to the sheet 20 at a point P where the path of travel intersects the sheet 20. A steep contact angle θ increases the risk that the lead edge 20'*a* of the subsequent sheet 20' will stub into the sheet 20 preventing the lead edge 20'*a* from reaching the nip of the output feed system 180 resulting in a jam. On the other hand, when the deflector 250 is in the second position in contact with the sheet 20, the sheet 20 is in its deformed configuration as described above. Here, the contact angle θ is must shallower than if the sheet 20 was in its original configuration. Thus, the risk of stubbing and drag on the subsequent sheet 20' is reduced.

Many features of the preferred embodiments represent design choices selected to best exploit the inventive concepts with respect to a particular implementation directed to a buckle accumulator of a specific sales volume and cost. However, those skilled in the art will recognize that various modifications can be made without departing from the spirit of the present invention to adapt the inventive concepts to other implementations.

For example, the deflector assembly 250 described above may be replaces by any suitable system that exerts a force on the sheet 20 sufficient to reconfigure the shape of the sheet 20, such as: supplying positive air flow, supplying negative air flow (vacuum) or moving a portion of the fixed support assembly 210.

As another example, any "key" arrangement between the deflector 252 and the locking hub 260 would be sufficient. The v-shaped extension 259*b* of the boss 259*a* on the mounting hub 259 and the notch 264 of the boss 262 were selected for convenience and ease of implementation.

Therefore, the inventive concepts in their broader aspects are not limited to the specific details of the preferred embodiments but are defined by the appended claims and their equivalents.

What is claimed is:

1. A buckle accumulator, comprising:

an input feed system for feeding a plurality of sheets in a path of travel into the buckle accumulator, each of the plurality of sheets having a leading edge and a trailing edge;

an output feed system located downstream in the path of travel from the input feed system for feeding a stack of sheets out of the buckle accumulator, the lead edge for each of the plurality of sheets being substantially unrestrained between the input feed system and the output feed system;

a receiving space located adjacent the path of travel between the input feed system and the output feed system for accepting the plurality of sheets one at a time to create the stack; and a deflector mounted in proximity to the receiving space for selectively actuating between a first position out of contact with a first sheet previously accumulated in the receiving space and a second position in contact with the first sheet, the first sheet having a first configuration when the deflector is in the first position and a second configuration when the deflector is in the second position; and wherein:

the deflector is in the second position when the lead edge of a second sheet is between the input feed system and the output feed system so that a portion of the first sheet in the second configuration forms a guide proximate to the receiving space and adjacent the path of travel to assist the lead edge of the second sheet in following the path of travel and entering the output feed system.

2. The buckle accumulator of claim 1, wherein:

the deflector is in the first position so that the first sheet is in the first configuration as the second sheet enters the receiving space.

3. The buckle accumulator of claim 2, wherein:

the deflector is in the second position as the stack of sheets are being fed out of the buckle accumulator ensuring that the stack of sheets are maintained in a nip of the output feed system.

4. The buckle accumulator of claim 3, wherein:

the deflector is part of a deflector assembly;

the deflector assembly further includes a rotary solenoid having an output shaft, a locking hub fixably mounted to the output shaft, a mounting hub slideably and rotatably mounted to the output shaft and a spring device operatively coupled to the locking hub and the mounting hub;

the deflector is fixably mounted to the mounting hub;

the spring device biases the deflector into an operative position with respect to the output shaft so that the deflector may actuate between the first position and the second position in response to selective energization of the rotary solenoid; and the deflector may be rotated opposite to the bias of the spring device into an inoperative position with respect to the output shaft to provide access to the receiving space.

5. The buckle accumulator of claim 4, wherein:

the locking hub and the mounting hub are in mating relationship when the deflector is in the operative position;

when the deflector is in the inoperative position, the locking hub and the mounting hub are not in mating relationship; and the spring device biases the locking hub and the mounting hub into mating relationship such that the deflector returns automatically to the operative position when released from the inoperative position.

6. A method of operating a buckle accumulator, comprising the step(s) of:

feeding a plurality of sheets in a path of travel into the buckle accumulator using an input feed system, each of the plurality of sheets having a leading edge and a trailing edge;

feeding a stack of sheets out of the buckle accumulator using an output feed system located downstream in the path of travel from the input feed system, the lead edge for each of the plurality of sheets being substantially unrestrained between the input feed system and the output feed system;

accepting the plurality of sheets one at a time into a receiving space located adjacent the path of travel between the input feed system and the output feed system to create the stack; and selectively actuating a deflector mounted in proximity to the receiving space between a first position out of contact with a first sheet previously accumulated in the receiving space and a second position in contact with the first sheet, the first sheet having a first configuration when the deflector is in the first position and a second configuration when the deflector is in the second position.

7. The method of claim 6, further comprising the step(s) of:

locating the deflector in the second position when the lead edge of a second sheet is between the input feed system and the output feed system so that a portion of the first sheet in the second configuration forms a guide proximate to the receiving space and adjacent the path of travel to assist the lead edge of the second sheet in following the path of travel and entering the output feed system.

8. The method of claim 7, further comprising the step(s) of:

locating the deflector to the first position so that the first sheet is in the first configuration as the second sheet enters the receiving space.

9. The method of claim 8, further comprising the step(s) of:

locating the deflector in the second position as the stack of sheets are being fed out of the buckle accumulator so that the stack of sheets are maintained in a nip of the output feed system.

10. The method of claim 9, further comprising the step(s) of:

biasing the deflector into an operative position with respect to an output shaft of a rotary solenoid;

selectively energizing the rotary solenoid so that the deflector may actuate between the first position and the second position; and rotating the deflector opposite to the biasing into an inoperative position with respect to the output shaft to provide access to the receiving space.

11. The method of claim 10, further comprising the step(s) of:

automatically returning the deflector to the operative position when the deflector is released from the inoperative position due to the biasing.

12. A method of manufacturing a buckle accumulator, comprising the step(s) of:

providing an input feed system capable of feeding a plurality of sheets in a path of travel into the buckle accumulator, each of the plurality of sheets having a leading edge and a trailing edge;

providing an output feed system located downstream in the path of travel from the input feed system capable of feeding a stack of sheets out of the buckle accumulator, the lead edge for each of the plurality of sheets being substantially unrestrained between the input feed system and the output feed system;

providing a receiving space located adjacent the path of travel between the input feed system and the output feed system capable of accepting the plurality of sheets one at a time to create the stack; and providing a deflector mounted in proximity to the receiving space and selectively actuatable between a first position out of contact with a first sheet previously accumulated in the receiving space and a second position in contact with the first sheet, the first sheet having a first configuration when the deflector is in the first position and a second configuration when the deflector is in the second position.

13. The method of claim 12, wherein:

the deflector is capable of entering the second position when the first sheet is in the receiving space so that a portion of the first sheet in the second configuration forms a guide proximate to the receiving space and adjacent the path of travel between the input feed system and the output feed system so that the lead edge of a second sheet is assisted in following the path of travel and entering the output feed system.

14. The method of claim 13, wherein:

the deflector is capable of entering the first position so that the first sheet is in the first configuration as the second sheet enters the receiving space.

15. The method of claim 14, wherein:

the deflector is capable of entering the second position as the stack of sheets are being fed out of the buckle accumulator so that the stack of sheets are maintained in a nip of the output feed system.

16. The method of claim 15, further comprising the step(s) of:

providing a spring device to bias the deflector into an operative position with respect to an output shaft of a rotary solenoid for actuating the deflector between the first position and the second position; and providing the deflector with the capability to rotate opposite to the biasing of the spring device into an inoperative position with respect to the output shaft to provide access to the receiving space.

17. The method of claim 16, further comprising the step(s) of:

providing the deflector with the capability to automatically return to the operative position when the deflector is released from the inoperative position due to the biasing of the spring device.

* * * * *